US008006859B2

(12) United States Patent
Clarke

(10) Patent No.: US 8,006,859 B2
(45) Date of Patent: Aug. 30, 2011

(54) DISPENSING DEVICE

(76) Inventor: Stephen William Clarke, Clitheroe (GB)

( * ) Notice: Subject to any disclaimer, the term of this patent is extended or adjusted under 35 U.S.C. 154(b) by 828 days.

(21) Appl. No.: 11/661,685

(22) PCT Filed: Sep. 22, 2005

(86) PCT No.: PCT/GB2005/003652

§ 371 (c)(1),
(2), (4) Date: Mar. 24, 2008

(87) PCT Pub. No.: WO2006/032981

PCT Pub. Date: Mar. 30, 2006

(65) Prior Publication Data

US 2008/0283531 A1 Nov. 20, 2008

(30) Foreign Application Priority Data

Sep. 22, 2004 (GB) ..... 0421014.2

(51) Int. Cl.
*B65D 1/24* (2006.01)

(52) U.S. Cl. ..... 220/500; 220/501; 220/502; 220/503; 220/504; 220/505

(58) Field of Classification Search ..... 220/501, 220/502, 503, 504, 505; 221/92, 123, 124, 221/130, 131, 9, 10, 174, 281
See application file for complete search history.

(56) References Cited

U.S. PATENT DOCUMENTS

| | | | | |
|---|---|---|---|---|
| 5,201,434 | A * | 4/1993 | DeVivo et al. | 220/315 |
| 5,997,052 | A * | 12/1999 | Reeb et al. | 292/148 |
| 6,186,555 | B1 * | 2/2001 | Rawlings | 283/81 |
| 6,343,845 | B1 * | 2/2002 | Woodard | 312/248 |
| 6,921,990 | B1 * | 7/2005 | Higgins | 307/328 |
| 6,938,771 | B2 * | 9/2005 | Friedrich et al. | 206/497 |
| 7,146,246 | B2 * | 12/2006 | Clarke | 700/236 |
| 2004/0144794 | A1 * | 7/2004 | Clarke | 221/2 |
| 2008/0047868 | A1 * | 2/2008 | Dege et al. | 206/545 |

FOREIGN PATENT DOCUMENTS

| | | |
|---|---|---|
| GB | 440059 | 6/1935 |
| GB | 882527 | 11/1961 |
| GB | 891869 | 3/1962 |
| GB | 969321 | 9/1964 |
| GB | 1088545 | 10/1967 |
| GB | 2 327 668 | 2/1999 |
| WO | 02/074138 | 9/2002 |
| WO | WO 02074138 A1 * | 9/2002 |

OTHER PUBLICATIONS

United Kingdom Search Report for application GB0421014.2 dated May 24, 2005.
International Search Report for PCT/GB2005/003652 dated Dec. 5, 2005.

* cited by examiner

*Primary Examiner* — Anthony Stashick
*Assistant Examiner* — Kareen Rush
(74) *Attorney, Agent, or Firm* — Smith, Gambrell & Russell, LLP

(57) ABSTRACT

A dispensing device comprising a housing having an upper loading chamber, a dispensing chamber located beneath the loading chamber and a gate movable between a first, open position and second, closed position to allow selective communication of the loading chamber and the dispensing chamber, entry to the lower chamber being by way of a door, the device further comprising a lock which prevents the door from opening when the gate is in the open position and which prevents opening of the gate, when the door is open.

32 Claims, 5 Drawing Sheets

Figure 1:
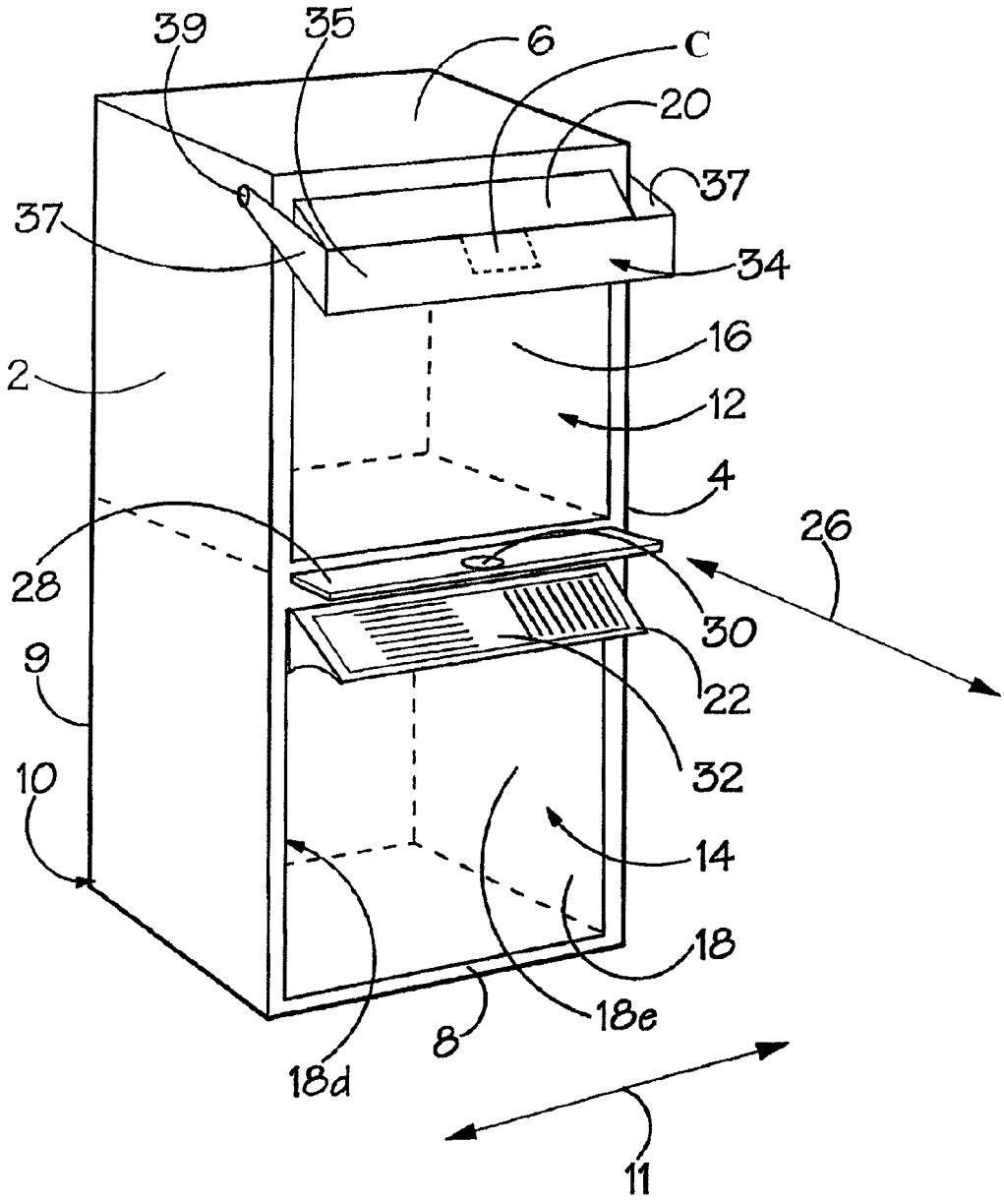

46
46
46
42
42
52
42
42

DISPENSING DEVICE

The present invention relates to a container for dispensing articles, the container having more than one area so that reserves of the articles can be accessed in a systematic way and stock control monitored and managed effectively.

There are a number of containers currently available which permit several containers to be placed adjacent to one another in a modular fashion so as to produce a "wall" of containers, each container housing different articles. Such walls of containers are often used in the automotive and aerospace industries to house a number of different articles such as nuts and bolts of varying sizes and such walls are often located close to or on a production or service site. Commonly, each container has a bar code adhered to it in order to assist a stock keeper in identifying the correct parts with which the container should be supplied. Whilst these containers have been used successfully in order to correctly locate stock and identify when new stock needs to be ordered, frequently, used stock is often dispensed at a rate greater than it is replenished and hold-ups in completing tasks often result whilst waiting for the new stock to be delivered or if previously-dispensed stock is replaced into an incorrect containers.

In order to address problems associated with these walls of containers, some companies have two or more adjacent containers for dispensing the same articles, therefore ensuring a plentiful supply of the required articles. This method also allows for a storeman to easily identify those stocks which require replenishment. These containers do, however, still have the problem in that there is no control over the container from which stock is dispensed and frequently articles are taken from any adjacent container which can make the task of the storeman to replenish required stocks rather difficult. Whilst some companies try to implement a system of dispensing articles from a predetermined row of containers prior to moving on to a further row of containers after the first row has been depleted, these systems are often ignored by engineers due to the pressure and other constraints under which they have to work.

Additionally, when a wall of containers has been built with appropriate containers labelled corresponding to the articles which they house, it is often difficult to insert additional containers into the wall should extra articles need to be held close by. Commonly, should the need arise for new containers to be added to the wall, they are often tagged on the end of the wall and this may be inappropriate if it would be more logically placed adjacent to another container(s) in the middle of the wall.

GB2327668 discloses a dispensing device having a housing which is divided into an upper loading chamber and a lower dispensing chamber by means of a shutter which is slidably mounted in the housing. The upper and lower chambers are provided with a respective hinged lid to allow access and the shutter may be withdrawn to allow the contents of the upper loading chamber to fall into the dispensing chamber. WO 02/074138 also discloses a dispenser with an upper loading chamber, a dispensing chamber located beneath the loading chamber, first and second openable covers for the loading chamber and a dispensing chamber and a gate means mounted in the housing between the two chambers and forming a lower wall of the loading chamber. The gate means is movable to allow selective communication of a loading chamber and the dispensing chamber to allow the contents of the loading chamber to fall into the dispensing chamber and the opening of the gate means to an extent sufficient to allow the contents to fall into the dispensing chamber that generates a signal from a limit switch indicative that the loading chamber is empty. Whilst both devices address a number of problems previously cited, they allow for stock to be taken from both chambers, which can still result in the store man not being able to clearly identify which stock requires replenishing It is therefore an object of the present invention to provide a container which overcomes or alleviates one or more of the problems associated with containers that are currently available. It is also an object of the present invention to provide a container which is capable of housing two or more reserves of articles for dispensing, wherein each reserve can only be replenished in a sequential manner. Furthermore, it is an additional object of the present invention to provide a container which can be easily integrated into an existing wall of containers such that the labels can be altered in order to accommodate the additional containers.

In accordance with the present invention, there is provided a dispensing device comprising a housing having an upper loading chamber, a dispensing chamber located beneath the loading chamber and a gate means movable between a first, open position and second, closed position to allow selective communication of the loading chamber and the dispensing chamber, entry to the lower chamber being by means of door means, the device further comprising a locking means which prevents the door means from opening when the gate is in the open position and which prevents opening of the gate means when the door means is open.

The present invention therefore provides for a dispensing device which prevents articles from dropping into the dispensing chamber from the loading chamber when the gate is disengaged, in addition to preventing movement of the gate, when the dispensing chamber is being accessed. This dispensing device not only saves time in retrieving articles which have dropped in inappropriate locations within the device, but it also encourages the user into a systematic approach to taking articles from the device from the dispensing chamber first.

Preferably, the opening of the movable gate means permits articles from the upper loading chamber to drop into the lower dispensing chamber. The gate means may comprise a handle projecting from the housing. Furthermore, the movement of the gate means may be actuated by a handle situated between the door means of the upper loading chamber and the door means of the lower dispensing chamber. The handle may simply be an aperture disposed in part of the gate which protrudes from the device and a hole to accommodate a finger or number of fingers.

The gate means and/or the door means may be operably coupled to the locking means. Furthermore, the device may further comprise a locking means which prevents the opening of the door means of the upper loading chamber until movement of the gate means has been actuated. The locking means may also prevent access to the loading chamber until the dispensing chamber has been accessed once and/or the gate has been disengaged once. Preferably, the movement of the gate is manually disengaged by hand by pulling a handle situated between the door of the upper loading chamber and the door of the lower dispensing chamber towards the user. The gate can then be re-engaged by pushing it back into its original position so as to release the door of the upper loading chamber in order that it can be replenished. The movement may be along the horizontal plane and the gate may be received in slots disposed horizontally within the device or alternatively ride along a ledge formed in the housing.

The lower dispensing chamber may comprise a receptacle in the shape of a square or rectangular cup or similar shape that corresponds to the interior of the chamber which in turn may be attached to the door such that the draw or cup moves relative to the door when it is open. Preferably, the doors are pivotally mounted on the housing.

The housing may be moulded or constructed in such a fashion as to direct any articles from the loading chamber directly into the lower chamber when the gate is opened. To this end, the interior of the housing between the gate and the receptacle of the dispensing chamber may be flush or inclined so that articles do not become lodged behind the receptacle of the dispensing chamber. Therefore, the interior of the housing may be shaped so as to recess and/or overhang at least part of the receptacle of the lower chamber. The interior of the housing may also comprise an inclined surface from the loading chamber to the dispensing chamber so that when the articles drop from the loading chamber to the dispensing chamber, they are directed to the centre of the receptacle, rather than being allowed to drop behind the part of the receptacle. It will be evident that this feature will be particularly useful when the articles in question are small and individually held in the device, rather than held in bags.

It is also preferred that the dispensing chamber door comprises two side panels that are in turn connected to the housing by means of an axis about which they pivot. The side panels may also be received in within two recessed channels in the housing, again so as to prevent articles from snagging or hampering the operation of the device.

The locking means may employ a number of mechanisms by which to prevent the door of the dispensing chamber from being opened unless the gate means has previously been disengaged and/or the gate is in an engaged position. Preferably, the locking means comprises a pin or latch. The pin or latch may be capable of being received in an aperture, depression or notch in the gate and/or the receptacle. The receptacle may further comprises curved inclined surfaces on which the pin or latch can travel over when the slidable gate is closed thereby allowing the door means to be opened. The gate means may also be slidable within two parallel orifices disposed within the interior of the housing. If a pin is employed in the device, it is preferable that the end of the pin that travels over the curved inclined surface is of an inclined/diagonal shape which is substantially complementary to the inclined surface. Furthermore, it is also preferred that the end of the pin also comprises an inwardly-extending projection or foot which contacts a curved inclined surface of the receptacle.

The door means may comprise handles. The doors of the chambers may have handles attached thereto and such handles may be located within the upper half of the door. The handles may further comprise a panel for receiving labels. Such a panel may be capable of receiving a label bracket with a label disposed thereon. Preferably, the label bracket is provided with an attachment means for releasably connecting a label to the label bracket. It will be apparent to one skilled in the art that the attachment means may employ a number of methods in order to allow for the label to be connected thereto. For example, the label may comprise a label tab that has one or more connection members that are received by one or more apertures on the label bracket. Furthermore, in order to assist in the positive engagement of the label with the label bracket, the connection members may protrude in a downward direction, that can be received in apertures on the label brackets that are in the shape of slots. In order to assist the positive engagement yet further, the connection members may terminate in a flange and the slot may be wider towards the top of the bracket so as to allow the insertion of the flange, but when the connection members are inserted in the apertures and the label pushed downwards, the flanges abut the underside of the label bracket and the label is firmly held in position by friction. The connection members and/or the label may also be produced from a resilient material so as to allow for the label to be easily placed and/or moved and/or replaced. The provision of the handle having a panel for receiving labels will allow walls of devices to have additional devices inserted and the labels rearranged if necessary in order to incorporate new or different articles as and when required. Such integration of new devices for articles will permit reordering of the articles to be relatively easy and accurate. Placing the labels on the handles themselves also assists the storeman identifying stocks which require replenishment as the label is not obscuring the view of the interior of the device should the doors be transparent unlike most prior art devices. The labels also allow for "buffer" dispensing devices to be incorporated in a wall of many devices, so that new articles can be easily incorporated into the wall.

The device may have two or more dispensing chambers and it will be apparent that multiple chambers may be provided such that the device is itself a wall of devices or a substantial part of one. Preferably, the devices have a connection means so as to permit a plurality of devices to be stacked adjacent to one another (either horizontally or vertically). Thus, the present invention provides for a modular dispensing device system which can be easily adapted depending on the requirements of the user and further adapted as and when required.

The dispensing device may additionally comprise a second locking means for preventing the door of the loading chamber from being opened. The second locking means may comprise a tab which can be manually engaged and disengaged such that this tab is only disengaged manually when the articles contained within the loading chamber have been completely depleted. The provision of a tab also reminds users of the dispensing device that access to the loading chamber should only be gained if articles have been depleted in the dispensing chamber beneath. The tab may be a bar which "clips" over the handle and such a bar may be manufactured so as to be lockable by a key, but equally a bar or a wire spanning a number of horizontally disposed dispensing devices may also be employed so as to prevent access to multiple loading chambers should it be required. The tab may move from an engaged to a disengaged position by the tab being disposed on two arms which are pivotally mounted on either side of the housing. Furthermore, the tab may also comprise a clip that positively engages the tab with the handle. It is therefore envisaged that in certain situations, the storeman is the only person with a key and therefore only authorized to have access to the loading chamber. It would be evident to one skilled in the art, that preventing complete access to the loading chamber without authorization may be appropriate in circumstances such as the pharmaceutical industry were stock replenishment may require validation etc. Preferably, the tab or bar is brightly coloured and optionally has words disposed thereon stating that the locking means must not be disengaged unless there are no more articles in the lower dispensing chamber/without validating some form of documentation. Thus, the user's attention is brought to the existence of the second locking means and also to any system or steps required to gain access to the second chamber.

The movement of the gate means and/or a door may be sensed electronically so that "real-time" stock levels can be monitored and access to each container logged if appropriate. Furthermore, the presence of articles in a given chamber may also be sensed electronically and this may be implemented by a simple circuit which requires two contacts to be brought together if there is any weight in any chamber. The electronic sensing may be relayed to a central processing unit for further analysis and/or stock ordering purposes. For example, the electronic sensing may be relayed to the central processing unit by means of an analogue or digital radio frequency transmission. In order to assist the central processing unit in its ordering and analysis, it is preferable to assign individual devices and/or chambers of respective devices with an identification code such that the location and quantity of articles can be appropriately monitored.

It will be evident to one skilled in the art that the electronic sensing means may be disposed in a number of positions within the device so that the stock levels and access to each container can be monitored accordingly. For example, an electronic sensing means may be disposed on a plate adjacent to the gate so that the actuation of the gate can be monitored and therefore the movement of stock from the loading chamber to the dispensing chamber monitored.

Figure 2:
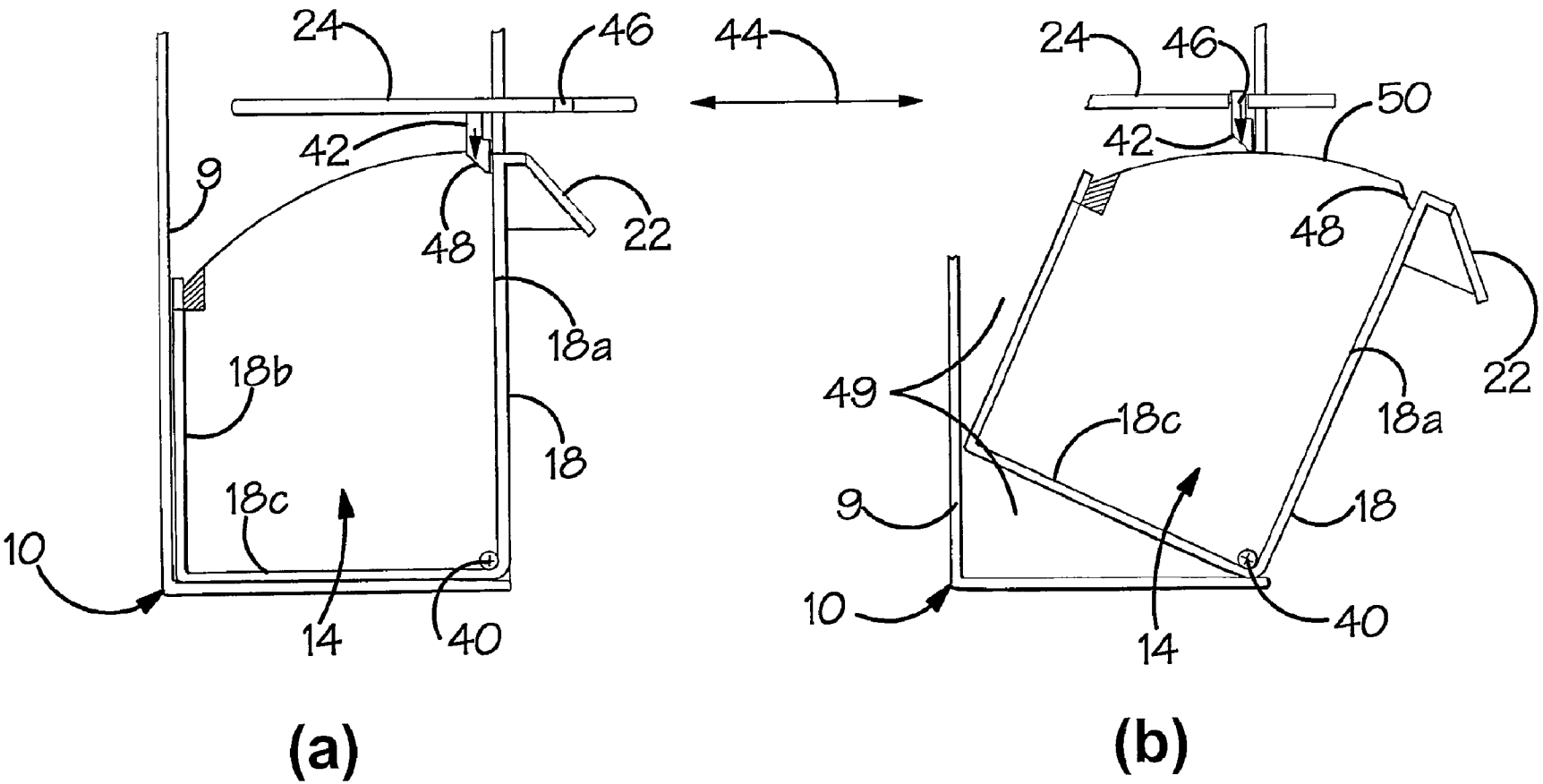
Figures 3A, 3B, 3C:
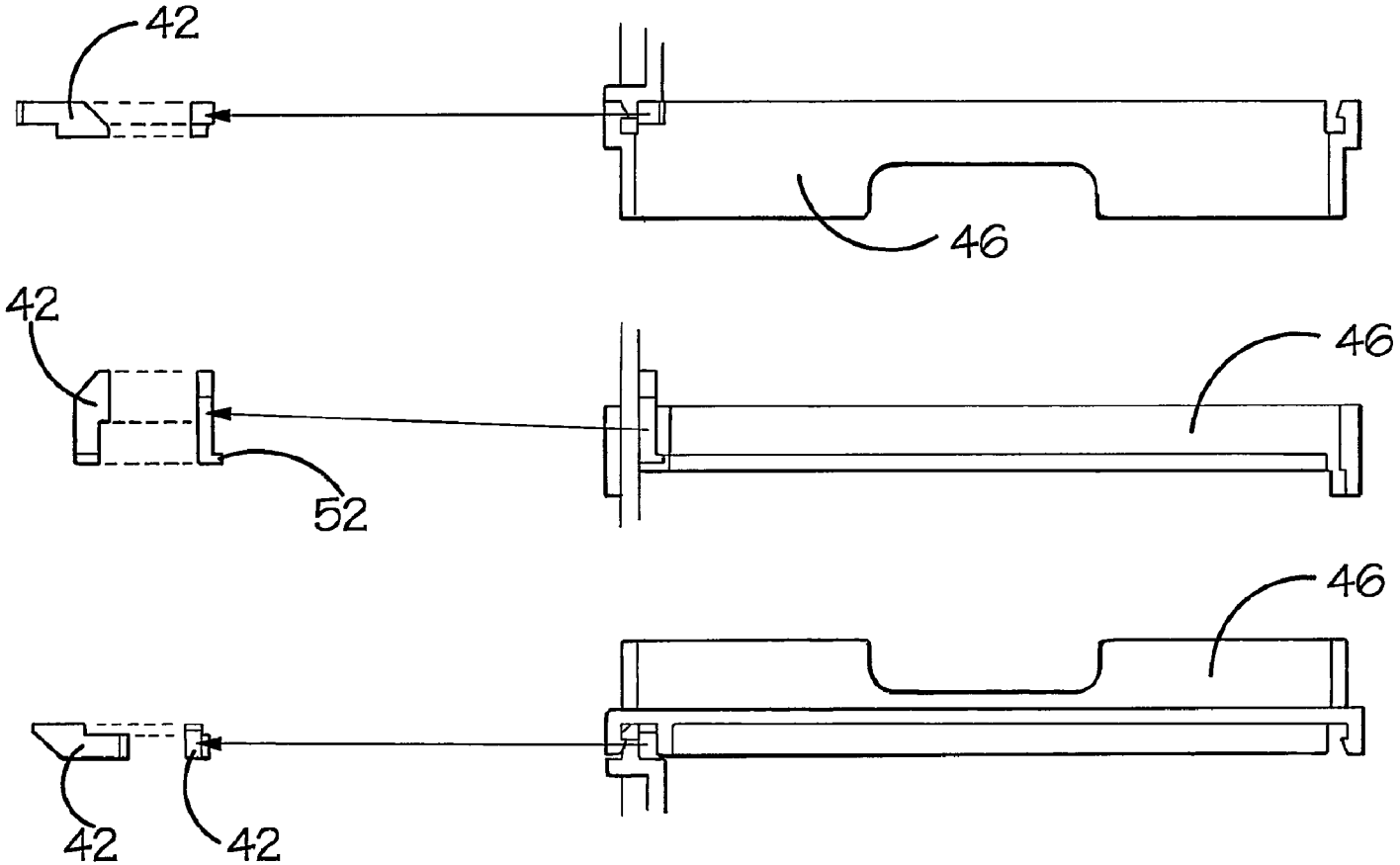

Specific embodiments of the present invention will now be described, by way of example only, with reference to the accompanying drawings, in which:

FIG. 1 illustrates a perspective view of an embodiment of a dispensing device in accordance with the present invention;

FIGS. 2*a* and 2*b* illustrate a cross-sectional side view of the lower chamber of the dispensing device as shown in FIG. 1 with the door shown in a closed and open configuration respectively;

FIGS. 3*a*, 3*b* and 3*c* illustrate a top, side and underneath view of the pin shown in FIGS. 2*a* and 2*b;*

Figure 4:
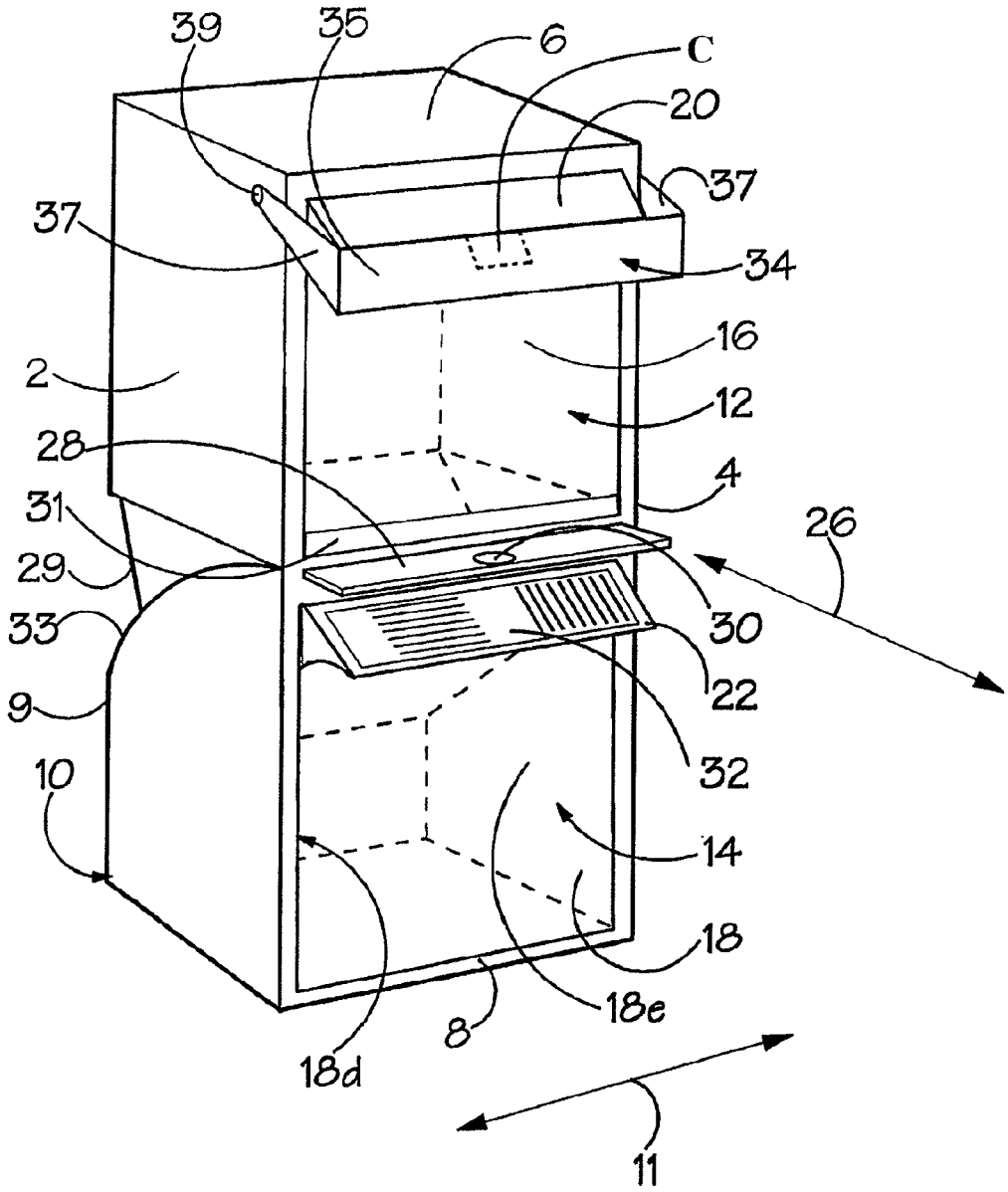

FIG. 4 illustrates a perspective view of a second embodiment of a dispensing in accordance with the present invention, differing from FIG. 1 by the housing having an inclined surface; and FIGS. 5*a* and 5*b* illustrate a cross-sectional side view of the lower chamber chamber of the dispensing device as shown in FIG. 4 with the door shown in a closed and open configuration respectively.

With reference to FIG. 1, FIG. 2 and FIG. 3, a dispensing device comprises a housing 10 in the shape of a rectangular box with two parallel, planar side walls 2,4 parallel upper and lower walls 6,8 extending perpendicular to the side walls 2,4 and a planar rear wall 9 extending perpendicular to the side walls 2,4 and to the upper and lower walls 6,8. The housing is divided into two discrete areas; a loading chamber 12 and a dispensing chamber 14, both of which can be accessed by means of hinged transparent doors 16 and 18 respectively, which are opened by means of a handle 20,22. Both doors 16 and 18 pivot about an axis towards the base of the doors extending in a direction perpendicular to the side walls. A slidable gate 24 is also provided in the device (shown in the engaged position in FIG. 1) which is disposed between the loading chamber 12 and the dispensing chamber 14. The gate 24 is received in two channels (not shown) provided on each opposed inner faces of the side walls 2,4 and can thereby slide in and out in direction 26 parallel to the upper and lower walls 6,8. The gate 24 also forms the base of the loading chamber 12 when engaged, and when disengaged permits communication between both chambers. The gate is slid into position by means of a handle 28 formed by a projecting portion of the gate which conveniently has a finger hole 30 disposed therein for a person to place a finger. The dispensing chamber 14 comprises an upwardly open receptacle having a planar front wall 18*a*, a parallel, shorter rear wall 18*b*, a planar base wall 18*c* extending perpendicularly between the front and rear walls and two planar side walls 18*d*,18*e* extending perpendicularly to the front, rear and back walls. The uppermost edges 50 of the side walls of receptacle 14 are curved convexly and at its front most portion the uppermost edge of one side wall 18*d* terminates in a locking recess 48, for engagement with a locking pin, as will be explained. The front of the receptacle forms the door 18. The loading chamber 12 is not attached to a receptacle and the gate 24 forms the base of the chamber 12, however the loading chamber has a door 16 which permits access to the chamber.

The uppermost front edge of the front face of each of the doors 16,18, is formed into a downwardly projecting handle 20,22 extending across the width of the door and a label 32 is attached to the handle 22 of the dispensing chamber 14. The label 32 contains information pertaining to the contents of the device and is supplied in addition to a bar code or similar tag. The label 32 can be placed or adhered to the handle 22 and may itself be capable of being fixed onto other handles either by means of a "snap fit" mechanism or alternatively the label may be inserted into an elongate aperture disposed within the handle 22 capable of receiving a label.

The locking chamber of the device is also provided with a locking bar 34 that is used to maintain the closure of the door 16 of the loading chamber 12 until opening is required. The locking bar consists of an elongate member 35 that is attached at either end to parallel arms 37 that are in turn pivotally connected to the side walls 2,4 by means of a pivot 39. The inner surface (not shown) of the elongate member 35 closely corresponds to the handle 20 of the door 16 such that the locking bar 34 (that may be brightly coloured with words or symbols disposed therein in) can clip, by way of clip "C", over the handle 20 and therefore prevent entry to the loading chamber 16 without first un-clipping the locking bar and pivoting the arms 37 to a position such that the locking bar does not impede the movement of the door 16.

As shown in FIGS. 2*a*, 2*b*, 3*a*, 3*b* and 3*c* (which includes reference numbers that correspond to those of FIG. 1) gate 24 is provided with a hole 46 or depression of non-circular cross-section which slidably receives a locking pin 42 of the same cross-section. The lower end of the locking pin 42 is provided with a horizontally and inwardly projecting lip or foot 52 which contacts the curved upper edge 50 of the side wall 18*d*. The lower end of the locking pin is complementarily shaped with the notch 48 in the upper edge of the side wall as described previously. The door 18 forms an integral part the receptacle and pivots about a stub axle 40. When the door 18 is in the closed position (FIG. 2*a*) the pin 42 drops by gravity into the notch 48. The notch 48 has an inclined surface corresponding to the base of the pin 42 and therefore the pin is received in the notch to allow the gate 24 in FIG. 2*a* to be moved freely in and out in the horizontal plane 44. When the gate 24 is slid outwardly, as shown in FIG. 2*a*, the hole 46 in the gate is no longer aligned with the pin 42 and as a result the upper end of the pin abuts the undersurface of the gate and is thereby held in engagement with the notch 48. Consequently, the door 18 is prevented from pivoting about axis 40 by its engagement with the pin 42.

When the gate 24 is in the closed position (as shown in FIG. 2*b*), the pin 42 is aligned with the orifice and is free to move through the aperture 46 in the gate 24. As the door 18 is pivoted forwardly, the inclined surfaces of the pin 42 and notch 48 cause the pin to be displaced upwardly, into the orifice 46 thereby both locking the gate in position and enabling the doors to continue to pivot about the axis 40. The lower end of the pin 42 can then slide over the curved inclined upper edge 50 of the side wall 18*d* of the receptacle to allow the door 18 to open. In this way the gate 24 is prevented from being slid when the door 18 is open.

In use, articles of the same or similar goods are placed in both the loading chamber 12 and the dispensing chamber 14 in preparation for dispensing. The bar 34 is clipped over the upper handle 20 to prevents the inadvertent opening of the door 16. The articles are readily identifiable by means of the label 32 disposed on the handle 22 and the articles held within the lower dispensing chamber, 14 are removed by opening the dispensing chamber door 18. When the lower chamber 14 is empty and requires refilling, the dispensing chamber door 18 is closed, which causes the locking pin 42 to drop into the notch 48. This allows the gate 24 to be slid outwards and at the same time engagement of the pin 42 in the notch 48 prevents the door 18 from being opened while the gate is open. Opening the gate 24 causes articles in the holding chamber 12 to drop into the dispensing chamber 14. The gate can then be slid shut, such that the pin is aligned with the orifice 46 in the gate, enabling the pin to displace upwardly into the orifice to allow the door 18 to be opened.

The loading chamber door 16 is further locked by the bar 34 which may have words disposed thereon to the effect that it may only be opened by authorised personnel etc. In its closed position, the pin 42 permits the gate 20 to move about the plane 26,44 and releasably locks the door 18 so that articles held in the loading chamber 12 can drop into the dispensing chamber 14 without becoming lodged in the space 49 formed by the receptacle which is attached to the lower door 18. The bar 34 can be unlocked to replenish stocks in the loading chamber as and when required.

Therefore, articles from the loading chamber cannot fall into the space 49 formed when the door 18 is opened (as shown in FIG. 2*b*).

The device can be used either singularly or placed adjacently to other devices. Structures on the exterior of the housing 10 can also be provided (not shown) thus assisting the device to the releasably attached to other device of a similar design.

The door 16 and 18 can be produced from a substantially transparent material such that a storeman or similar personnel may assess the quantity of articles contained within either the upper chamber 12 or the lower chamber 14. The device 10 may also have two or more loading chambers, whereby entry to the top chamber is only by means of actuating one or more gates below. The housing 10 can also have structures on the exterior such that it can be releasably attached to other devices so as to form a modular dispensing device. The label 32 may have a bar code or information relating to which articles are contained within device and it is envisaged that this label can be used for pre-ordering or tracking of stock.

Figure 5:
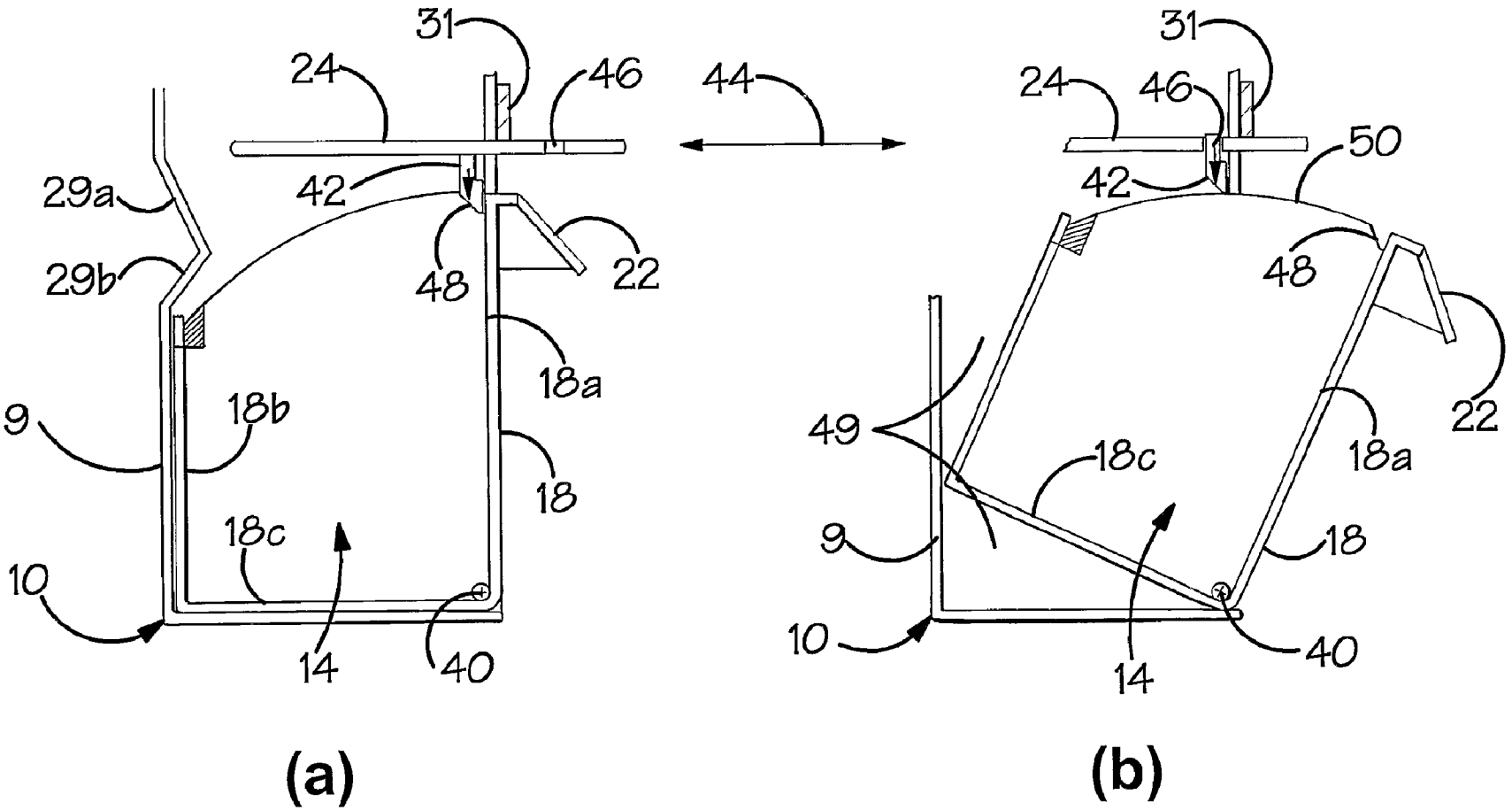

A second embodiment of the present invention is shown in FIGS. 4 to 5*b* and has almost identical features and therefore the same reference numbers are used as for the common features in FIGS. 1 to 3*b*. In the second embodiment, a panel 31 is also provided immediately above the gate 24 for attaching additional labels/instruction (and/or an electronic sensor for detecting the movement of the gate 24) to the device. The rear wall 9 of the housing 10 is also formed into an inwardly-directed projection having inclined upper and lower planar walls 29*a*, 29*b* which serves to direct articles into the receptacle of the lower dispensing chamber 14. The side walls 2,4 are also each provided with a recess 61 having a curved lowermost wall 33 which corresponds to the shape of a respective one of the upper edges of the dispensing chamber 14. This also helps to prevent articles from becoming lodged between the dispensing chamber 14 and the housing, whilst allowing the chamber to be pivoted as described previously. As the receptacle of the dispensing chamber 14 is recessed within the housing 10 (by means of the curved lowermost wall 33) and the housing further has an inclined surface 29, the articles are directed towards the interior of the dispensing chamber, so that the articles do not drop behind or to the side of the receptacle.

Multiple dispensing devices may be joined to one another by a range of methods and structures may be provided on the exterior of the housing may permit the devices to be joined to one another in a modular fashion. The movement of the gate can be linked to electronic switches/sensors, so that its movement can be detected and relayed to a computer such that the ordering of stock can be automated or semi-automated. Should more than one device be used, each device can have an identification code assigned to it, so that the correct part or product is ordered. Whilst the electronic switch/sensor can be placed in a number of positions on the device, ideally, it will be positioned adjacent to the gate 24, on the panel 31 so as to monitor the movement of the gate. The electronic switches and/or sensors can be incorporated into the device during its production, or retrofitted to existing devices if need be.

The invention claimed is:

1. A dispensing device comprising a housing having an upper loading chamber, a dispensing chamber located beneath the loading chamber and a gate means movable between a first, open position and second, closed position to allow selective communication of the loading chamber and the dispensing chamber, entry to the lower chamber being by means of door means, the device further comprising a locking means which prevents the door means from opening when the gate is in the open position and which prevents opening of the gate means when the door means is open.

2. A device as claimed in claim 1, wherein opening of the movable gate means permits articles from the upper loading chamber to drop into the lower dispensing chamber.

3. A device as claimed in claim 1, wherein the gate means comprises a handle projecting from the housing.

4. A device as claimed in claim 2, wherein the movement of the gate means is actuated by a handle situated between the door means of the upper loading chamber and the door means of the lower dispensing chamber.

5. A device as claimed in claim 1, wherein the gate means and/or the door means are operably coupled to the locking means.

6. A device as claimed in claim 1, wherein the locking means further prevents the opening of the door means of the upper loading chamber until movement of the gate means has been actuated.

7. A device as claimed in claim 1, wherein the lower dispensing chamber comprises a receptacle.

8. A device as claimed in claim 1, wherein the door means is pivotally mounted on the housing.

9. A device as claimed in claim 7, wherein the locking means comprises a pin or latch.

10. A device as claimed in claim 9, wherein one end of the pin or latch comprises an inwardly extending projection which contacts the lower dispensing chamber.

11. A device as claimed in claim 9, wherein the pin or latch is capable of being received in an aperture or notch in the gate means and/or the receptacle.

12. A device as claimed in claim 9, wherein the receptacle has at least one side panel having an inclined surface on which the pin or latch can travel over when the gate is closed thereby allowing the door means to be opened.

13. A device as claimed in claim 1, wherein the gate means is slidable within two parallel channels disposed within the interior of the housing.

14. A device as claimed in claim 1, wherein the door means further comprises a handle.

15. A device as claimed in claim 14, wherein the handle further comprises a panel for receiving labels.

16. A device as claimed in claim 15, wherein the panel is capable of receiving a label bracket with a label disposed thereon.

17. A device as claimed in claim 16, wherein the label bracket further comprises an attachment means for allowing a label to be releasably connected thereto.

18. A device as claimed in claim 17, wherein the attachment means comprises one or more connection members that are received by one or more apertures located on the label bracket.

19. A device as claimed in claim 1, wherein the door means is transparent.

20. A device as claimed in claim 1, wherein there are two or more loading chambers.

21. A device as claimed in claim 1, wherein the device has a connection means to allow a plurality of devices be connected to one another.

22. A device as claimed claim 1, wherein the device further comprises a second locking means for preventing the door means of the upper loading chamber to be opened.

23. A device as claimed in claim 22, wherein the second locking means comprises a tab with a clip that releasably engages the door means.

24. A device as claimed in claim 22, wherein the second locking means can be moved from an engaged to a disengaged position by the second locking means being disposed on two arms that are pivotally mounted on either side of the housing.

25. A device as claimed in claim 23, wherein the tab is brightly coloured.

26. A device as claimed in claim 23, wherein the tab has words or symbols disposed thereon.

27. A device as claimed in claim 1, wherein the movement of the gate means can be sensed electronically.

28. A device as claimed in claim 27, wherein the presence and/or pressure of articles in a loading chamber can also be sensed electronically.

29. A device as claimed in claim 27, wherein the electronic sensing is relayed to a central processing unit.

30. A device as claimed in claim 27, wherein an electronic sensor is disposed adjacent to the gate.

31. A device as claimed in claim 27, wherein an identification code is assigned to the device.

32. A device as claimed in claim 1, wherein the locking means comprises a pin or latch configured for receipt in an aperture or notch in the gate means.

* * * * *